US005631621A

United States Patent [19]

Nakajima

[11] Patent Number: 5,631,621

[45] Date of Patent: May 20, 1997

[54] CARTRIDGE THERMAL FUSE WITH AN ADHESIVE METAL EXCELLENT IN ADHESION WITH THE MELTED FUSIBLE ALLOY

[76] Inventor: Takuo Nakajima, 13-30, Yamatecho 4-chime, Suita-shi, Osaka-fu, Japan

[21] Appl. No.: 577,220

[22] Filed: Dec. 22, 1995

[30] Foreign Application Priority Data

Dec. 22, 1994 [JP] Japan ..... 6-336107
Apr. 18, 1995 [JP] Japan ..... 7-117833

[51] Int. Cl.[6] ..... H01H 85/38

[52] U.S. Cl. ..... 337/280; 337/273; 337/227

[58] Field of Search ..... 337/201, 252, 337/227, 228, 268, 273, 279, 280

[56] References Cited

U.S. PATENT DOCUMENTS 4,636,765 1/1987 Krueger ..... 337/273

5,262,750 11/1993 Gurevich ..... 337/273

*Primary Examiner*—Leo P. Picard

*Assistant Examiner*—Jayprakash N. Gandhi

*Attorney, Agent, or Firm*—Birch, Stewart, Kolasch & Birch, LLP

[57] ABSTRACT

The thermal fuse comprises a fuse base having a wire fuse element of a fusible alloy connecting lead wires and a cartridge forming an enclosed space for accommodating the wire fuse element by surrounding the wire fuse element and closing both ends thereof at the lead wires. In this space, a sucker having a suction surface composed of an adhesive metal excellent in adhesion with the fusible alloy is disposed.

9 Claims, 8 Drawing Sheets

CARTRIDGE THERMAL FUSE WITH AN ADHESIVE METAL EXCELLENT IN ADHESION WITH THE MELTED FUSIBLE ALLOY

BACKGROUND OF THE INVENTION

The present invention relates to a thermal fuse simplified in constitution, capable of cutting off current feed in an electric circuit securely and reliably at a set temperature, and favorably used also in an electric circuit relatively large in a current capacity.

FIELD OF THE INVENTION

Recently the thermal fuse is used widely as safety switch for cutting off an electric circuit when the ambient temperature exceeds a specified value, thereby preventing burning of the electric circuit and electric appliance, and hence occurrence of fire.

In this thermal fuse, part of an electric circuit is composed by using a fuse element wire of fusible alloy low in melting point, and when the ambient temperature exceeds the melting point, it is melted to cut off the electric circuit. Therefore, when used in an electric circuit of a large current capacity, in particular, a relatively thick wire fuse element is employed, and it is required to cut off the current feed by spacing a large amount of melted fusible alloy securely from the lead wire.

Accordingly, hitherto, in a thermal fuse of which rated current is, for example, larger than 5 A, a coil spring was incorporated, and when the wire fuse element was melted, the fusible alloy was spaced from the lead wire by the resetting spring force of this coil spring.

In such prior art, the structure was complicated, and the manufactured needed much labor in compressing and incorporating the coil spring, which caused to lower the production efficiency and raise the production cost. Moreover, when melting, the expanded coil spring becomes unstable, and the coil spring may sometimes contact with the armor of the thermal fuse or the like to induce new disasters such as electric shock and current leak.

SUMMARY OF THE INVENTION

It is hence a primary object of the invention to provide a thermal fuse capable of solving the conventional problems, primarily by installing a suction of an adhesive metal excellent in adhesion with the melted fusible alloy, in a space of a cartridge insulated from the lead wires, thereby cutting of current feed in the circuit securely in a simple structure.

According to one aspect of the present invention, a thermal fuse comprising a fuse base connecting lead wires to both ends of a wire fuse element composed of a fusible alloy, and a cartridge extending between the lead wires in the lengthwise direction, while surrounding the wire fuse element, and of which both ends being fixed and closed at the lead wires so as to form an enclosed space for accommodating the wire fuse element, wherein the cartridge and lead wires are insulated, and a sucker having a suction surface composed of an adhesive metal excellent in adhesion with the melted fusible alloy is disposed in the space, while facing the suction surface to the wire fuse element.

The sucker may be a disk disposed in contact with or closely to the end surface of the wire fuse element, or a cup having its bottom disposed in contact with or closely to the end surface of the wire fuse element.

The sucker may be also an external ring to be externally fitted into a central part of the wire fuse element, and this external ring may be a disk formed by blanking a flat plate by a press, a coil formed by spirally winding a wire material, or a tubular form formed by cylindrically winding a hoop material.

BRIEF DESCRIPTION OF THE DRAWINGS

An embodiment of the present invention will now be described, by way of example, referring to the attached diagrammatic drawings, in which.

DETAILED DESCRIPTION OF THE INVENTION

Figure 1:
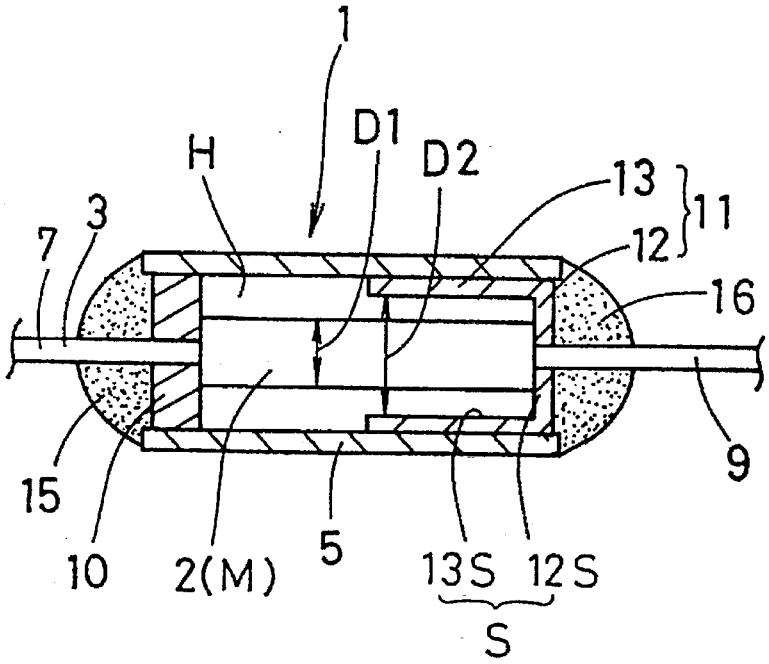
FIG. 1 is a sectional view showing an embodiment of the invention in which a sucker is in a cup form.

In FIG. 1, a thermal fuse 1 comprises a fuse base 3 having a wire fuse element 2 composed of a fusible alloy M, and a cartridge 5 surrounding the wire fuse element 2 of the fuse base 3. A sucker 11 having a suction surface S composed of an adhesive metal excellent in adhesion to a melted fusible alloy M is fixed in a space H inside the cartridge 5.

FIGS. 1 to 5 show a preferable thermal fuse having a rated current greater than 5 A, and FIGS. 6 to 15 show a preferable thermal fuse having a rated current not greater than 5 A.

The fuse base 3 is composed of the wire fuse element 2 made of the fusible alloy M melted by heating, and lead wires 7, 9 connected to both ends of the wire fuse element 2. As the fusible alloy M, for example, a known alloy M of low melting point comprising lead (Pb), tin (Sn), cadmium (Cd), bismuth (Bi) or the like may be used. In this embodiment, the alloy M of Pb (30.6 wt. %), Sn (51.2 wt. %), and Cd (18.2 wt. %) is used, and its melting point is set around 140 to 160 degrees, for example, about 150 degrees, and its wire diameter is set depending on the rated current of the electric circuit to be applied in. The lead wires 7, 9 may be ordinary conductive wires, and are, for example, soft copper wires having the surface plated with tin, and are connected to the wire fuse element 2 by welding or the like so as to be conductive.

The cartridge 5 surrounds the wire fuse element 2, and extends between the lead wires 7, 9 at both ends in the length-wise direction, and, in this example, it is a tubular form composed of flame retardant insulator such as thermo-setting plastics, ceramics, and glass. The inside diameter of the cartridge 5 is larger than the outside diameter D1 of the wire fuse element 2, and its both ends are sealed as being filled with insulating end members 15, 16 made of, for example, acrylic or epoxy ultraviolet setting adhesive, and the lead wires 7,9 are affixed. Therefore, the cartridge 5 forms a sealed space H for accommodating the wire fuse element 2 in its inside. In this example, having a high rated current, the cartridge 5 is relatively large in diameter, and hence a side piece 10 for stabilizing further the fixing of the cartridge 5 by fitting into one end of the cartridge 5 is disposed in the space H. The other end of the cartridge 5 is held in the lead 9 through the sucker 11 having the suction surface S.

The sucker 11 is composed of, in this embodiment, an adhesive metal excellent in adhesion to a melted fusible alloy M, and is shaped in a cup form comprising a peripheral part 13 for receiving the inner circumference of the cartridge 5, and a bottom 12 for closing the peripheral part 13 while allowing to penetrate the lead 9. Therefore, the bottom surface 12S of the bottom 12, and the inner surface 13S of the peripheral surface 13 form the suction surface S facing the wire fuse element 2.

Examples usable as the adhesive metal include, among others, gold, platinum, silver, copper, metal for composing the fusible alloy M, metal of test piece uniform in wet state without forming granules of fusible alloy M on the immersion surface when the test piece is taken out after immersing in melted fusible alloy M according to the solder wettability test in par. 9.9 of JIS (Japanese Industrial Standard) H 8621, and their alloys. The suction surface S may be formed, aside from forming the sucker 11 itself of adhesive metal as in this embodiment, also by plating the sucker 11 with an adhesive metal and forming the suction surface S on the surface. At this time, the main body of the sucker 11 may be formed also of other metal than adhesive metal, and plastics and others. Herein, as plating process, aside from electric plating, vacuum deposition, painting, and other coating processes may be included.

Figure 2:
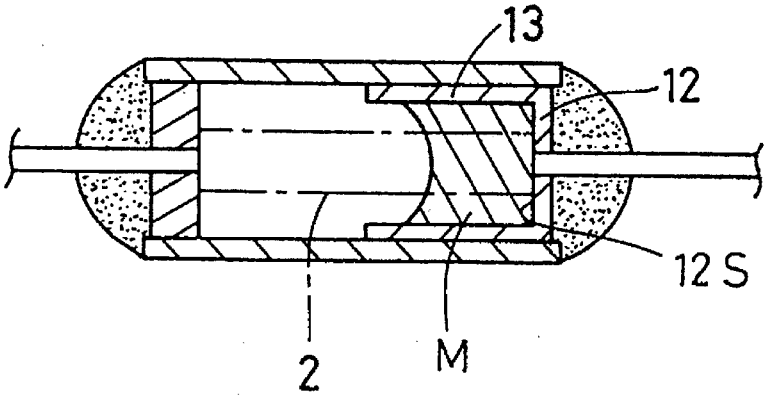
FIG. 2 is an action diagram explaining its operation.

Part of the suction surface S is preferred to contact with or be close to the wire fuse element 2, and in this example, the bottom 12S substantially contacts with the end surface of the wire fuse element 2. The inner surface 13S forms a gap to the outer circumference of the wire fuse element 2. The diameter D2 of the inner circumference 13S is preferred to be 1.3 to 1.6 times the diameter D1 of the wire fuse element 2, and the front end of the inner surface 13S is preferred to be terminated near the middle position of the length of the wire fuse element 2. When the wire fuse element 2 melts, as shown in FIG. 2, the fluidized alloy M is pulled to the bottom 12S by its adhesion and surface tension, and by forming a cap shape by the bottom 12S and inner surface 13S, the surface tension and other forces are intensified. In the specified range of 1.3 to 1.6 times, it is guaranteed that the melted alloy M may be securely moved and contained in the cap-shaped space. Meanwhile, if the diameter D2 of the inner surface 13S is smaller than 1.3D1, the accommodating volume is not sufficient, or if exceeding 1.6D1, to the contrary, increase of surface tension and other forces is not sufficiently expected. Incidentally, the sucker 11 may be formed only of the peripheral part 13, excluding the bottom 12, depending on the request.

The lead wires 7, 9 of the fuse base 3, cartridge 5, sucker 11, and side piece 10 are adhered through the end member 15, and formed into one body, and leaving the lead wires 7,9, the remainder is securely insulated. The active agent is applied on the outer surface of the wire fuse element 2.

Figure 3:
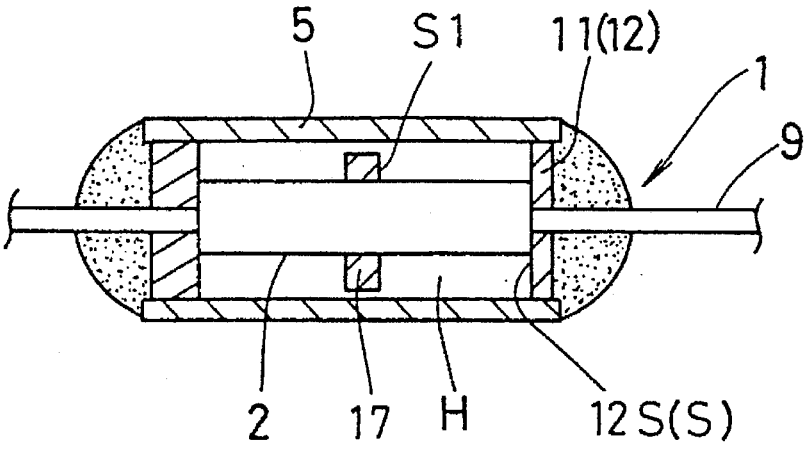
FIG. 3 is a sectional view showing an example of a disk-form sucker.
Figure 4:
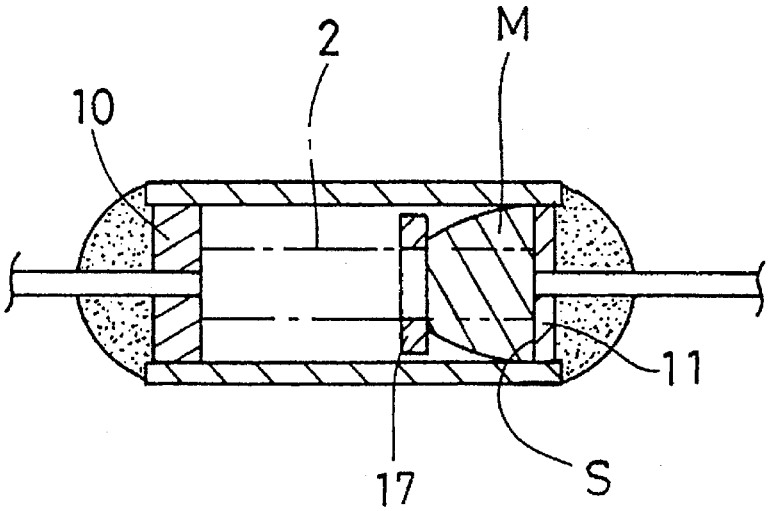
FIG. 4 is an action diagram explaining its operation.

FIGS. 3 and 4 show other embodiment of the thermal fuse 1. In the diagram, the sucker 11 is a disk formed only of the bottom 12 substantially contacting with the end surface of the wire fuse element 2, and the suction surface S facing the space H is formed by the side surface 12S of the bottom 12. As a result, the fluidized alloy M is pulled to the side surface 12S, and is converged at one lead wire side. However, to enhance the tensile force, a ring-shaped movable piece 17 made of adhesive metal may be fitted to the wire fuse element 2, at a middle length position of the wire fuse element 2. The outside diameter of the movable piece 17 is sufficiently smaller than the inside diameter of the cartridge 5, and this movable piece 17 forms an auxiliary suction surface S1 facing the suction surface S.

Therefore, as shown in FIG. 4, when the wire fuse element 2 melts, the fluidized alloy M instantly moves into the space between the movable piece 17 and suction surface S by the interaction of the movable piece 17 and suction surface S, and the circuit is cut off securely. At this time, the suction surface S may be also formed on the inward surface of the side piece 10.

Figure 5:
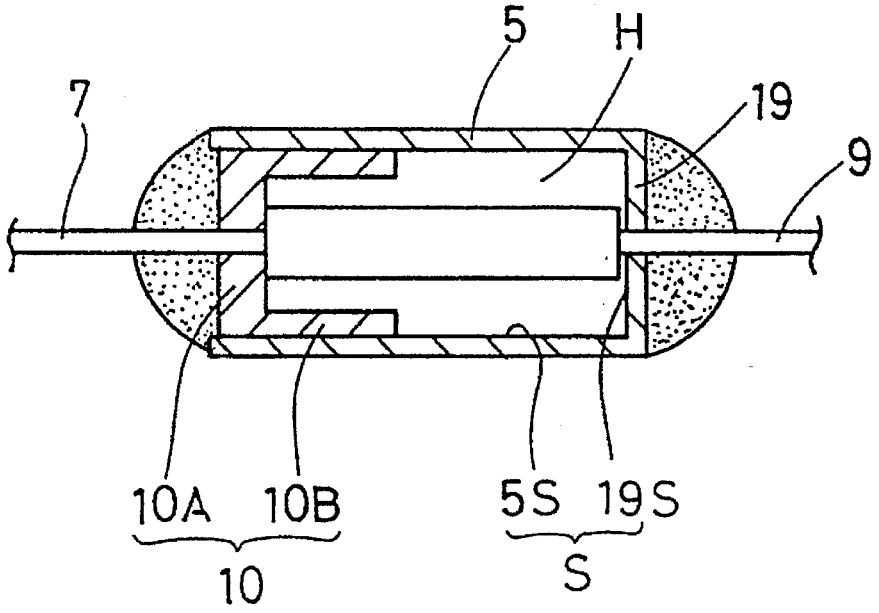
FIG. 5 is a sectional view showing an example of constitution in which the inner surface of a cartridge forms a sucker.

FIG. 5 shows a different embodiment of the thermal fuse 1. In the diagram, the cartridge 5 is a tubular form with a bottom having the inner surface plated with an adhesive metal, and its bottom portion 19 penetrates through the lead wire 9 at the other end, and is held in the lead wire 9. The side piece 10 has a cylindrical receptacle 10B for receiving the inner surface 5S of the cartridge 5,on the circumference of the disk-shaped base part 10A penetrating the lead wire 7 at one side. Therefore, the side piece 10 has its receptacle 10B covering one side end along the inner surface 5S of the cartridge 5, and the remainder of the inner surface 5S and the bottom 19S are exposed to the space H. As a result, the cartridge 5 forms a cup-shaped suction surface S nearly same as in FIG. 1, by this exposed surface. The front end of the receptacle 10B is preferred to be terminated at the middle length position of the wire fuse element 2, and the bottom 19S substantially contacts with the end of the wire fuse element 2.

Explained below is a case in which the sucker 11 is an external ring 21 fitted externally in the wire fuse element 2. The external ring 21 is shaped like a disk, coil or cylinder, and is made of adhesive metal, and hence at least the inner surface forms the suction surface S substantially contacting with the wire fuse element 2. In the thermal fuse 1 shown in FIGS. 6 to 15, the cartridge 5 is relatively small in diameter, and its both ends can be directly fixed in the lead wires 7, 9, only by filing with end members 15,16, without using side piece 10. Or the side piece 10 may be used.

Figure 6:
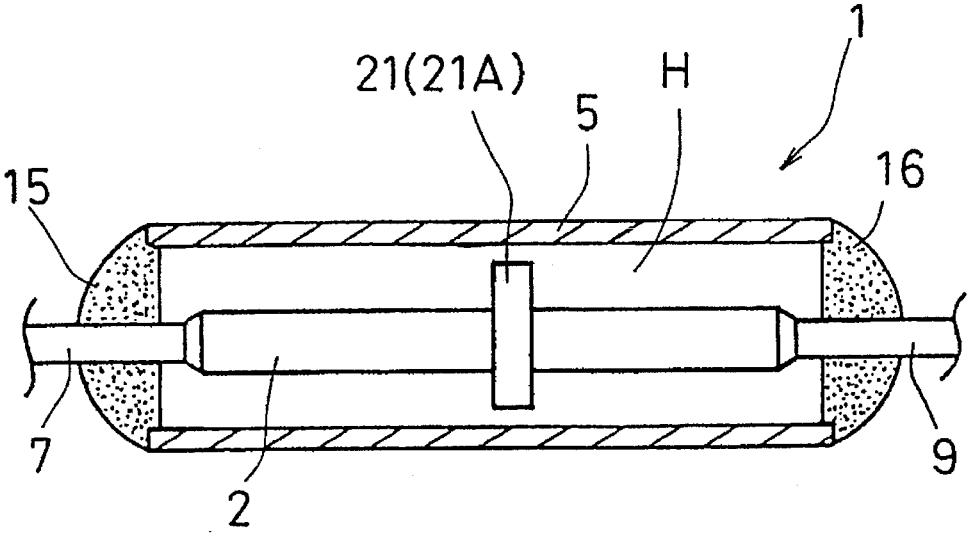
FIG. 6 is a sectional view showing an embodiment in which an external ring is in a disk form.
Figure 8:
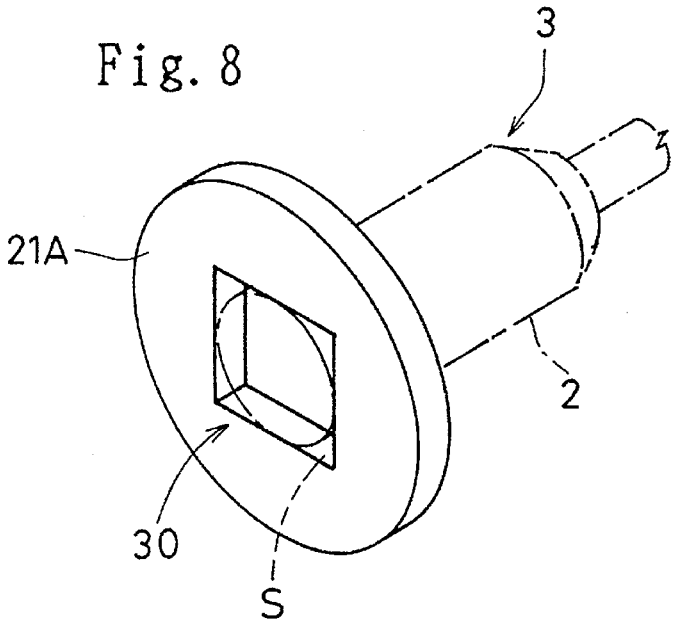
FIG. 8 is a magnified perspective view of a disk form.
Figure 9:
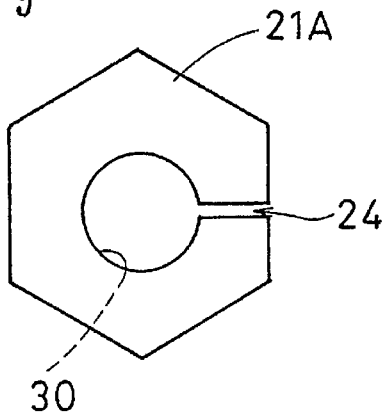
FIG. 9 is a front view showing other example of a disk form.

As the external ring 21, as shown in FIGS. 6, 8, a flat plate of adhesive metal may be blanked by a press to be formed into a disk 21A, and is provided in the middle length position of the wire fuse element 2. The disk 21A has a central hole 30 for fitting the wire fuse element 2, and as this central hole 30 is polygonal, such as triangular or quadrangular, it contacts with the wire fuse element 2 at two or more points. As a result, insertion of the disk 21A into the wire fuse element 2 is facilitated, and deviation of position after insertion is prevented. For the purpose of point contact, meanwhile, the central hole 30 may be elliptical. When the central hole 30 is circular, after inserting with a play in the wire fuse element 2, the disk 21A may be crimped in the direction of diameter to fix, or as shown in FIG. 9, a division 24 may be formed as a slit in the disk 21A to be in C-form, and the central hole 30 may have a spring property.

In particular, when the disk 21A contacts at points, at the time of application of active agent on the wire fuse element 2, by the action of the adhesive force and surface tension of the active agent, the active agent is held for a long time between the wire fuse element 2 and central hole 30, and oxidation of wire fuse element 2 is prevented.

Meanwhile, since the disk 21A does not contact with the wire fuse element, heat conductivity with the wire fuse element 2 is high, and the temperature of the disk 21A rises earlier than other temperature due to specific heat or the like. Therefore, the disk 21A functions like a heat source, and starting from this contact portion, the wire fuse element 2 is melted quickly at the initial set temperature, so that the sensing precision and sensing speed of the thermal fuse 1 may be enhanced.

Figure 7:
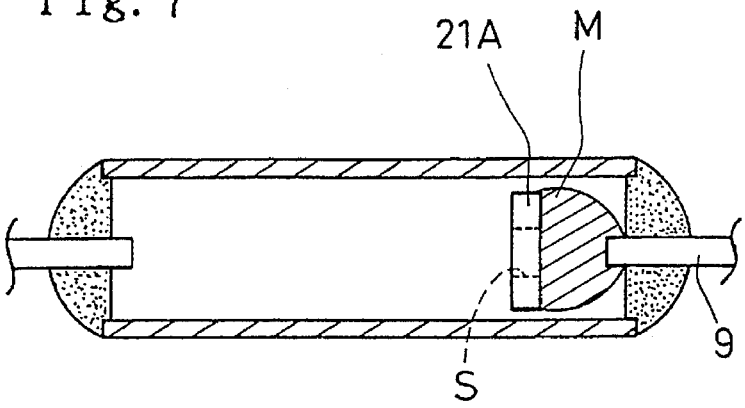
FIG. 7 is a sectional view showing a fused state of its wire fuse element.

When the wire fuse element 2 melts, starting from the contact portion with the disk 21A, the fluidized alloy M is pulled to the disk 21A by the suction force, and the disk 21A itself is pulled to the one lead wire 9 side by the suction force, and is far departed from the lead wire 7 of the other end side as shown in FIG. 7, thereby cutting off the circuit. The disk 21A may be also used as the movable piece 17 (shown in FIGS. 3, 4).

Figure 10:
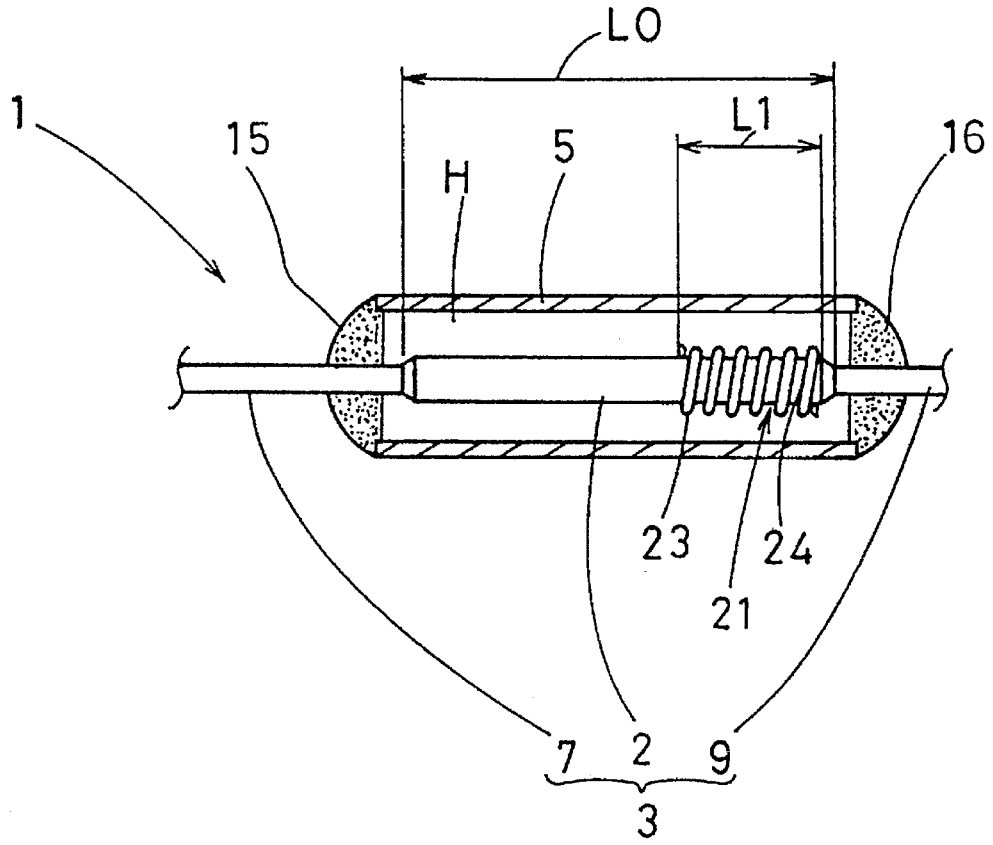
FIG. 10 is a sectional view showing an embodiment in which an external ring is in a coil form.
Figure 11:
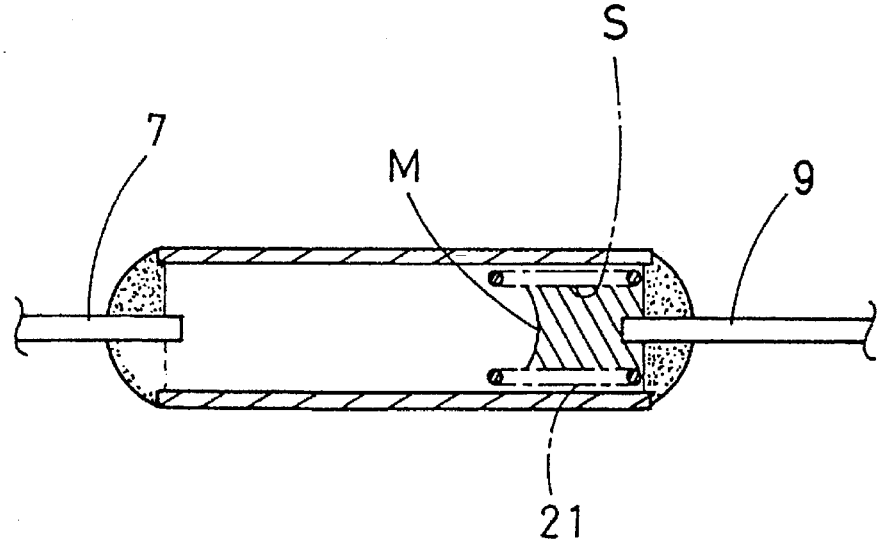
FIG. 11 is a sectional view showing a fused state of its wire fuse element.

In FIGS. 10, 11, the external ring 21 is a coil 21B. The coil 21B is composed of a wire material 23 of adhesive metal spirally wound around the wire fuse element 2, and a division line 24 formed between adjacent wire materials 23, 23 is extended from one end to the other end of the coil 21B, so that the diameter is variable. As a result, the coil body 24B is fitted into the wire fuse element 2. The coil 21B, same as the disk 21A, holds the active agent invading from the division line 24, against the wire fuse element 2, for a long period.

Figure 12:
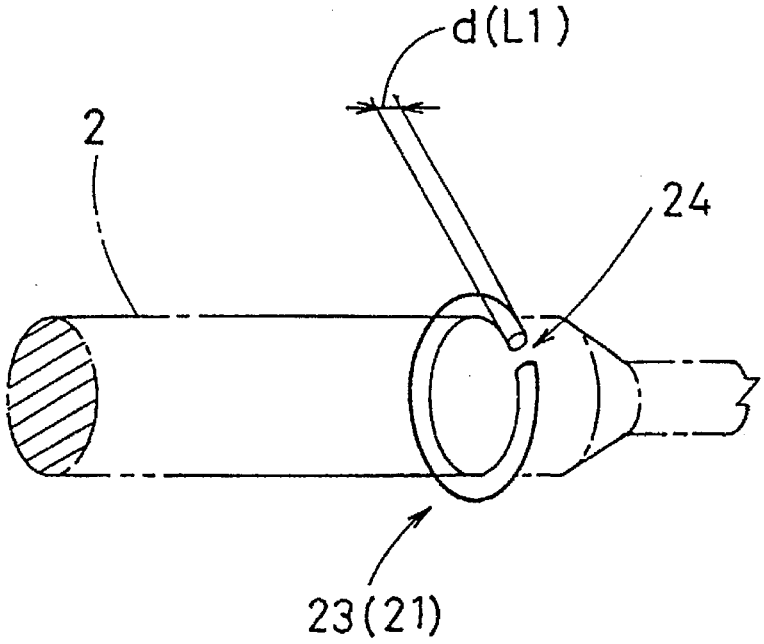
FIG. 12 is a perspective view showing other embodiment of a coil form.

When the wire fuse element melts 2, the fluidized alloy M is pulled to the lead wire 9 at one end side together with the coil 21B as shown in FIG. 11, and the circuit is cut off, and the coil 21B is expanded in diameter as the sucked amount of fluidized alloy M increases, and the accommodating capacity of the fluidized alloy M is enhanced. The coil 21B, as shown in FIG. 12, may also function as the core for sucking the melting start point of the wire fuse element 2 and fluidized alloy M into one, as far as the wire material 23 is wound about a turn in a C-form. Therefore, the lower limit of the length of the external ring 21 is about the diameter d of the wire material 23, and plate thickness of the disk 21A. However, from the viewpoint of the melting start point and suction function, the disk 21A of wide surface area and large thermal capacity is preferred. As the upper limit, in order to cut off the circuit securely, the external fitting length L1 of the external ring 21 is required to be 0.5 times or less of the length L0 of the wire fuse element 2. As the wire material 23, a copper wire with diameter of about 0.05 to 0.3 mm, or preferably about 0.1 mm is used.

Figure 13:
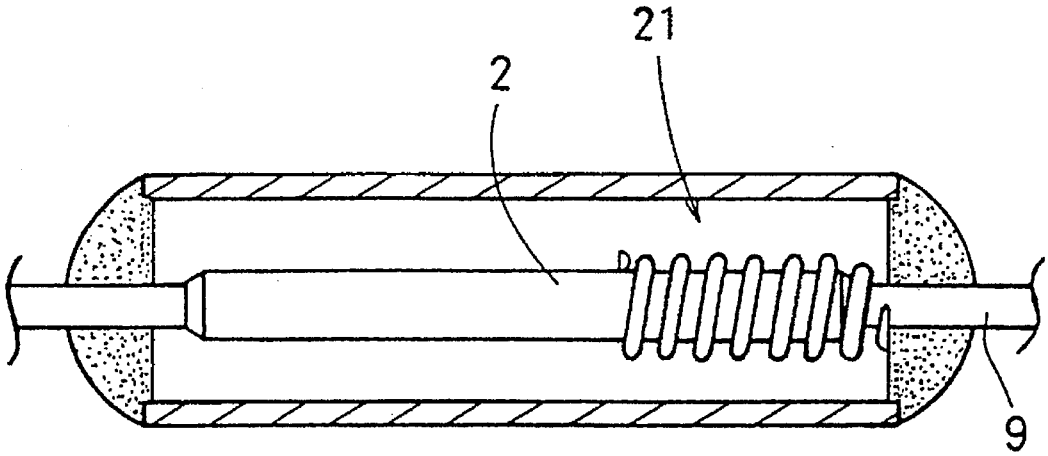
FIG. 13 is a sectional view showing a different embodiment of a coil form.

FIG. 13 shows other embodiment of the coil 21B. In the diagram, the coil 21B has one end wound on the lead wire 9 at one side, thereby assuring fixing of the coil body 21B and preventing deviation of position in the longitudinal direction.

Figure 14:
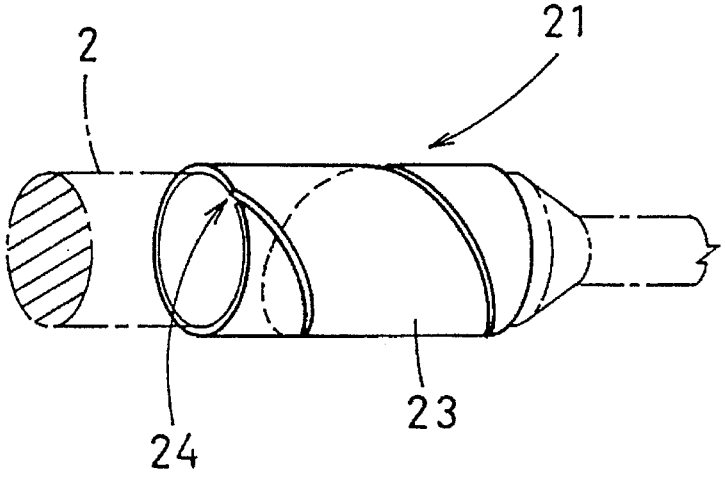
FIG. 14 is a perspective view showing an embodiment in which an external ring is in a tubular form.

In FIG. 14, the external ring 21 is a tubular form 21C. In the diagram, the tubular form 21C is formed by winding spirally a narrow hoop material 26 of adhesive metal. In this case, too, since the division line 24 is extended spirally, and uniform penetration of adhesive agent is maintained. Still more, the contact area with the wire fuse element 2 is wide and the heat conductivity is excellent and heat capacity is high, so that melting of high precision is achieved.

Figure 15:
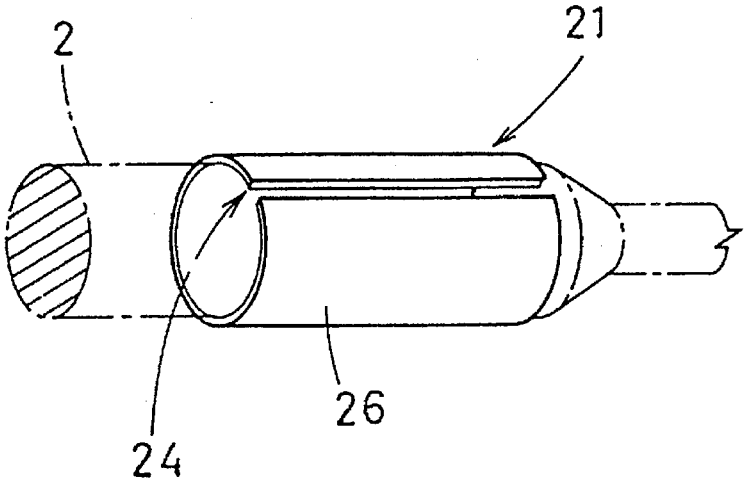
FIG. 15 is a perspective view showing other embodiment of a tubular form.

FIG. 15 shows a different embodiment of the tubular form 21C. In the diagram, the tubular form 21*c* formed by winding a hoop material 26 parallel, and the contact area with the wire fuse element 2 is wide, and the heat capacity is high, so that melting at high precision is realized.

Figure 16:
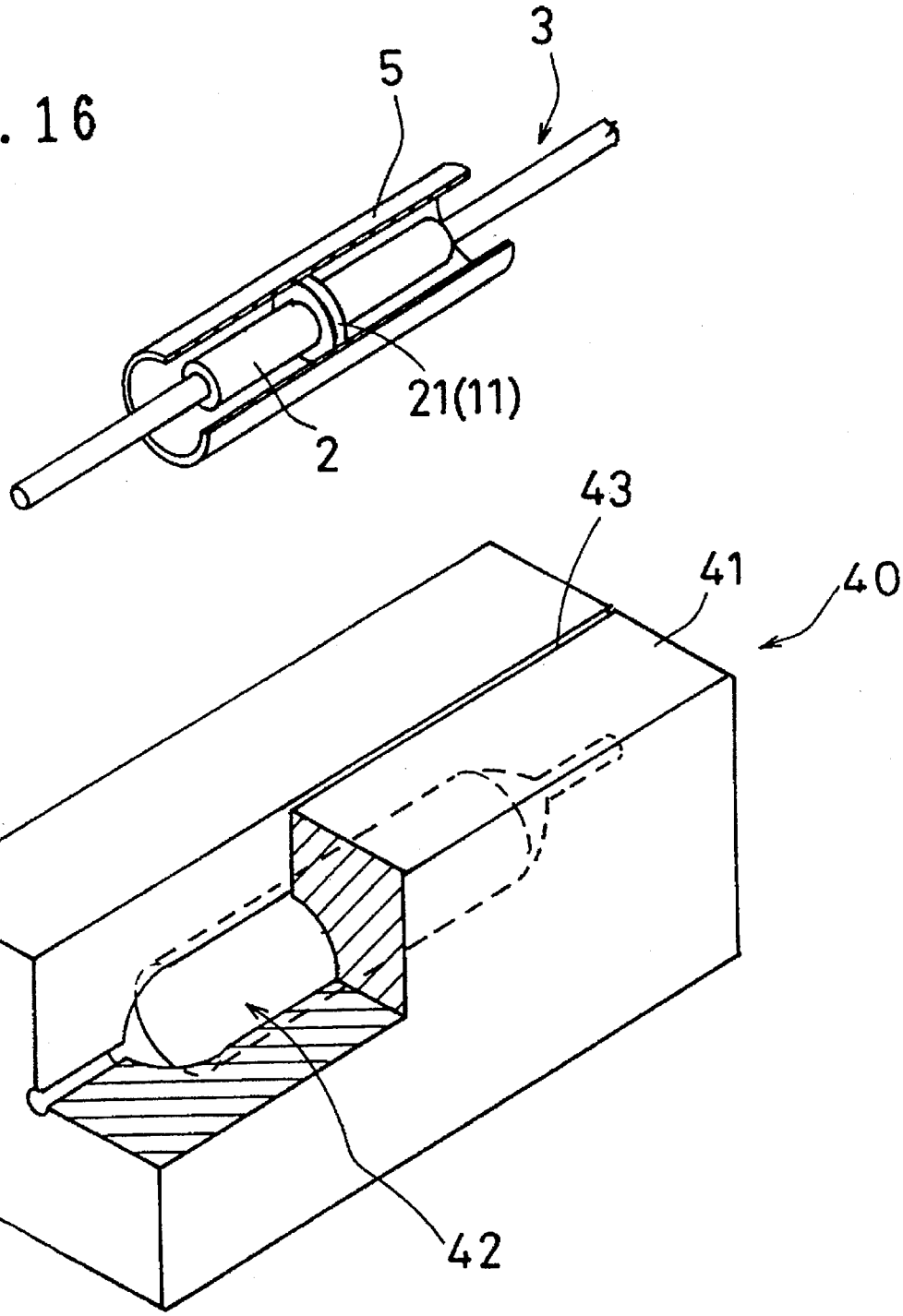
FIG. 16 is a perspective view showing a manufacturing process of a thermal fuse using a forming die.

Such thermal fuse 1 may be formed easily and precisely by using a light transmission type forming die 40 as shown in FIG. 16. As the forming die 40, a transparent elastic material of silicone rubber or the like may be preferably used, and a space 42 for forming the thermal fuse 1 is formed inside a block 41. In the block 41, a slit 43 for taking out the formed piece extending from its upper surface to the space 42 is provided.

In the manufacturing process, the fuse is assembled by inserting a light transmission type cartridge 5 of, for example, glass into the fuse base 3 having a suction ring 21 preliminarily fitted into the wire fuse element 2. After putting this assembly into the forming die 40 by slightly opening the slit 43, an adhesive of ultraviolet curing property is injected into both ends of the cartridge 5 of this assembly, and the both ends of the cartridge 5 are closed. The adhesive is injected from the gap in the slit 43 by using an injector. While the assembly is held in the forming die 40, it is carried into the ultraviolet ray irradiation room, and the adhesive is cured by the ultraviolet rays transmitting through the forming die 40 and cartridge 5, thereby forming end members 15,16. While curing, the cartridge 5 and fuse base 3 are held concentrically in the forming die 40, and hence the thermal fuse of high precision may be produced easily. Using the forming die 40 and cartridge 5 of light transmission property, defective assembly or other defects can be visually judged prior to curing, so that defective may be decreased notably. Or, after injecting the adhesive into the assembly, the assembly may be fitted and formed in the forming die 40. The forming die 40 may be preferably formed in split type when using non-elastic material such as glass and synthetic resin.

What is claimed is:

1. A thermal fuse comprising a fuse base composed of a wire fuse element made of a fusible alloy melted by heating and lead wires connected to both ends of the wire fuse element and a cartridge extending between the lead wires in the lengthwise direction thereof, while surrounding the wire fuse element, and of which both ends being fixed and closed at the lead wires so as to form an enclosed space for accommodating the wire fuse element, wherein the cartridge and lead wires are insulated, and a sucker having a suction surface composed of an adhesive metal excellent in adhesion with the melted fusible alloy is disposed in the space, while facing the suction surface to the wire fuse element.

2. The thermal fuse of claim 1, wherein said sucker is a disk having the suction surface formed on the side surface disposed in contact with or closely to the end surface of the wire fuse element.

3. The thermal fuse of claim 1, wherein said sucker is a cup having the suction surfaces formed on the circumferential surface surrounding the wire fuse element and on the bottom closing the circumferential surface in contact with or closely to the end surface of the wire fuse element.

4. The thermal fuse of claim 1, wherein said sucker is an external ring having a length L1 of not more than 0.5 times the length L0 of the wire fuse element to be externally fitted to the wire fuse element, and having the suction surface formed on the surface.

5. The thermal fuse of claim 4, wherein said external ring is a disk having a central hole in which the wire fuse element is fitted.

6. The thermal fuse of claim 4, wherein said external ring has the central hole formed in a polygonal shape so as to contact with the wire fuse element at two or more points.

7. The thermal fuse of claim 4, wherein said external ring has a division line extending continuously from one end to the other end so that the inside diameter of the external ring may be variable.

8. The thermal fuse of claim 7, wherein said external ring is a spiral coil of adhesive metal wire material, and the adjacent wire material sides form the division line.

9. The thermal fuse of claim 7, wherein said external ring is a cylindrically wound tubular form of an adhesive metal hoop material, and the winding start end and winding terminal end of the hoop material form the division line.

* * * * *